US005244861A

United States Patent [19]

Campbell et al.

[11] Patent Number: 5,244,861

[45] Date of Patent: Sep. 14, 1993

[54] RECEIVING ELEMENT FOR USE IN THERMAL DYE TRANSFER

[75] Inventors: Bruce C. Campbell, Rochester; Daniel J. Harrison; Jong S. Lee, both of Pittsford; Larry K. Maier; William A. Mruk, both of Rochester; Cheryl L. Warner, Brockport, all of N.Y.

[73] Assignee: Eastman Kodak Company, Rochester, N.Y.

[21] Appl. No.: 922,927

[22] Filed: Jul. 31, 1992

Related U.S. Application Data

[63] Continuation-in-part of Ser. No. 822,523, Jan. 17, 1992, abandoned.

[51] Int. Cl.[5] ..... B41M 5/035; B41M 5/38

[52] U.S. Cl. ..... 503/227; 428/195; 428/315.5; 428/318.4; 428/318.8; 428/910; 428/913; 428/914

[58] Field of Search ..... 8/471; 428/195, 286, 428/313.3, 315.5, 316.6, 317.9, 323, 910, 913, 914; 503/227

[56] References Cited

U.S. PATENT DOCUMENTS

| | | | |
|---|---|---|---|
| 4,704,323 | 11/1987 | Duncan et al. | 428/286 |
| 4,774,224 | 9/1988 | Campbell | 503/227 |
| 4,778,782 | 10/1988 | Ito et al. | 503/227 |
| 4,971,950 | 11/1990 | Kato et al. | 503/227 |

FOREIGN PATENT DOCUMENTS

| | | | |
|---|---|---|---|
| 0322771 | 7/1989 | European Pat. Off. | 503/227 |
| 0452121 | 10/1991 | European Pat. Off. | 503/227 |
| 03-76687 | 4/1991 | Japan | 503/227 |

*Primary Examiner*—Bruce H. Hess
*Attorney, Agent, or Firm*—Andrew J. Anderson

[57] ABSTRACT

Thermal dye transfer receiving elements are disclosed comprising a base having thereon a dye image-receiving layer, the base comprising a composite film laminated to a support, the dye image-receiving layer being on the composite film side of the base. The composite film comprises a microvoided thermoplastic core layer and at least one substantially void-free thermoplastic surface (skin) layer.

20 Claims, No Drawings

RECEIVING ELEMENT FOR USE IN THERMAL DYE TRANSFER

CROSS REFERENCE TO RELATED APPLICATION

This application is a continuation-in-part of copending U.S. Application Ser. No. 07/822,523 filed Jan. 17, 1992, now abandoned.

Reference is also made to co-pending, commonly assigned U.S. Ser. No. 07/822,522 of Warner et al., the disclosure of which is incorporated by reference, which relates to dye-receiving elements used in thermal dye transfer containing cellulose fiber paper supports.

This invention relates to dye-receiving elements used in thermal dye transfer, and more particularly to receiving elements containing microvoided composite films.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method For Controlling A Thermal Printer Apparatus," issued Nov. 4,1986, the disclosure of which is hereby incorporated by reference.

Dye-receiving elements used in thermal dye transfer generally comprise a polymeric dye imagereceiving layer coated on a base or support. In a thermal dye transfer printing process, it is desirable for the finished prints to compare favorably with color photographic prints in terms of image quality. The thermal dye receiver base must possess several characteristics for this to happen. First of all, transport through the printer is largely dependent on the base properties. The base must have low curl and a stiffness that is neither too high or too low. The base has a major impact on image quality. Image uniformity is very dependent on the conformability of the receiver base. The efficiency of thermal transfer of dye from ability to maintain a high temperature at its surface. The look of the final print is largely dependent on the base's whiteness and surface texture. Receiver curl before and after printing must be minimized. Cellulose paper, synthetic paper, and plastic films have all been proposed for use as dye-receiving element supports in efforts to meet these requirements.

U.S. Pat. No. 4,774,224 describes using a resin coated paper with a surface roughness measurement of 7.5 Ra microinches-AA or less. This type of paper is generally used for photographic bases, and consequently, it has the photographic look. This base has excellent curl properties both before and after printing, and due to it's simple design is relatively inexpensive to manufacture. However, it is not very conformable and under printing conditions with low pressure between a print head and a printer drum, it does not yield high uniformity prints (most commercial printers are now being built with low printing pressures to make them more cost effective). Also higher energy levels are needed to achieve a given density U.S. Pat. No. 4,778,782 discloses laminating synthetic paper to a core material, such as of natural cellulose paper, and describes how synthetic paper used alone as a receiver base suffers from curl after printing. Synthetic papers are disclosed in, for example, U.S. Pat. No. 3,841,943 and U.S. Pat. No. 3,783,088, and may be obtained by stretching an orientable polymer containing an incompatible organic or inorganic filler material. By this stretching, bonds between the orientable polymer and fillers in the synthetic paper are destroyed, whereby microvoids are considered to be formed. These bases provide good uniformity and efficiency. The laminated structures do improve curl properties, but still do not meet all curl requirements. Further, the synthetic paper support, due to it's voided paper-like surface, will not produce the inherent gloss that most photographic prints have.

European Patent Application 0 322 771 discloses dye-receiving element supports comprising a polyester film containing polypropylene and minute closed cells within the film formed upon stretching.

U.S. Pat. No. 4,971,950 addresses the curl problem seen after printing when synthetic paper is laminated on both sides of a core material. It illustrates using a heat relaxed (lower heat shrinkage) synthetic paper on the printed side and a nonrelaxed synthetic paper on the back side. This base provides good uniformity, efficiency and curl properties. It also does not provide a glossy surface and may require another step in manufacturing.

U.S. Pat. No. 4,704,323 describes microvoided composite films similar to those described in this application, however, no mention is made of their suitability for thermal dye-transfer printing.

There is a need to develop a receiver base which can fulfill all of these requirements. That is, a base that is planar both before and after printing, yields an image of high uniformity and dye density, has a photographic look and is inexpensive to manufacture. It is thus an object of this invention is to provide a base for a thermal dye-transfer receiver which exhibits low curl and good uniformity and provides for efficient dye-transfer.

These and other objects are accomplished in accordance with the invention, which comprises a dye-receiving element for thermal dye transfer comprising a base having thereon a dye image-receiving layer, wherein the base comprises a composite film laminated to a support, the dye image-receiving layer being on the composite film side of the base, and the composite film comprising a microvoided thermoplastic core layer having a strata of voids therein and at least one substantially void-free thermoplastic surface (skin) layer. Due to their relatively low cost and good appearance, these composite films are generally used and referred to in the trade as "packaging films. The support may include cellulose paper, a polymeric film or a synthetic paper. A variety of dye-receiving layers may be coated on these bases.

Unlike synthetic paper materials, microvoided packaging films can be laminated to one side of most supports and still show excellent curl performance. Curl performance can be controlled by the beam strength of the support. As the thickness of a support decreases, so does the beam strength. These films can be laminated on one side of supports of fairly low thickness/beam strength and still exhibit minimal curl.

The low specific gravity of microvoided packaging films (preferably between 0.3–0.7 g/cm$^3$) produces dye-receivers that are very conformable and results in low mottle-index values of thermal prints as measured on an instrument such as the Tobias Mottle Tester. Mottle-index is used as a means to measure print uniformity, especially the type of nonuniformity called dropouts which manifests itself as numerous small unprinted areas. These microvoided packaging films also are very insulating and produce dye-receiver prints of high dye density at low energy levels. The nonvoided skin produces receivers of high gloss and helps to promote good contact between the dye-receiving layer and the dye-donor film. This also enhances print uniformity and efficient dye transfer.

Microvoided composite packaging films are conveniently manufactured by coextrusion of the core and surface layers, followed by biaxial orientation, whereby voids are formed around void-initiating material contained in the core layer. Such composite films are disclosed in, for example, U.S. Pat. No. 4,377,616, the disclosure of which is incorporated by reference.

The core of the composite film should be from 15 to 95% of the total thickness of the film, preferably from 30 to 85% of the total thickness. The nonvoided skin(s) should thus be from 5 to 85% of the film, preferably from 15 to 70% of the thickness. The density (specific gravity) of the composite film should be between 0.2 and 1.0 g/cm$^3$, preferably between 0.3 and 0.7 g/cm$^3$. As the core thickness becomes less than 30% or as the specific gravity is increased above 0.7 g/cm$^3$, the composite film starts to lose useful compressibility and thermal insulating properties. As the core thickness is increased above 85% or as the specific gravity becomes less than 0.3 g/cm$^3$, the composite film becomes less manufacturable due to a drop in tensile strength and it becomes more susceptible to physical damage. The total thickness of the composite film can range from 20 to 150 microns, preferably from 30 to 70 microns. Below 30 microns, the microvoided films may not be thick enough to minimize any inherent non-planarity in the support and would be more difficult to manufacture. At thicknesses higher than 70 microns, little improvement in either print uniformity or thermal efficiency are seen, and so there is little justification for the further increase in cost for extra materials.

"Void" is used herein to mean devoid of added solid and liquid matter, although it is likely the "voids" contain gas. The void-initiating particles which remain in the finished packaging film core should be from 0.1 to 10 microns in diameter, preferably round in shape, to produce voids of the desired shape and size. The size of the void is also dependent on the degree of orientation in the machine and transverse directions. Ideally, the void would assume a shape which is defined by two opposed and edge contacting concave disks. In other words, the voids tend to have a lens-like or biconvex shape. The voids are oriented so that the two major dimensions are aligned with the machine and transverse directions of the film. The Z-direction axis is a minor dimension and is roughly the size of the cross diameter of the voiding particle. The voids generally tend to be closed cells, and thus there is virtually no path open from one side of the voided-core to the other side through which gas or liquid can traverse.

The void-initiating material may be selected from a variety of materials, and should be present in an amount of about 5–50% by weight based on the weight of the core matrix polymer. Preferably, the void-initiating material comprises a polymeric material. When a polymeric material is used, it may be a polymer that can be melt-mixed with the polymer from which the core matrix is made and be able to form dispersed spherical particles as the solution is cooled down. Examples of this would include nylon dispersed in polypropylene, polybutylene terephthalate in polypropylene, or polypropylene dispersed in polyethylene terephthalate. If the polymer is preshaped and blended into the matrix polymer, the important characteristic is the size and shape of the particles. Spheres are preferred and they can be hollow or solid. These spheres may be made from cross-linked polymers which are members selected from the group consisting of an alkenyl aromatic compound having the general formula Ar-C(R)=CH$_2$, wherein Ar represents an aromatic hydrocarbon radical, or an aromatic halohydrocarbon radical of the benzene series and R is hydrogen or the methyl radical; acrylate-type monomers include monomers of the formula CH$_2$=C(R')—C(O)(OR) wherein R is selected from the group consisting of hydrogen and an alkyl radical containing from about 1 to 12 carbon atoms and R' is selected from the group consisting of hydrogen and methyl; copolymers of vinyl chloride and vinylidene chloride, acrylonitrile and vinyl chloride, vinyl bromide, vinyl esters having formula CH$_2$=CH(O)-COR, wherein R is an alkyl radical containing from 2 to 18 carbon atoms; acrylic acid, methacrylic acid, itaconic acid, citraconic acid, maleic acid, fumaric acid, oleic acid, vinylbenzoic acid; the synthetic polyester resins which are prepared by reacting terephthalic acid and dialkyl terephthalics or esterforming derivatives thereof, with a glycol of the series HO(CH$_2$)$_n$OH wherein n is a whole number within the range of 2–10 and having reactive olefinic linkages within the polymer molecule, the above described polyesters which include copolymerized therein up to 20 percent by weight of a second acid or ester thereof having reactive olefinic unsaturation and mixtures thereof, and a cross-linking agent selected from the group consisting of divinylbenzene, diethylene glycol dimethacrylate, diallyl fumarate, diallyl phthalate and mixtures thereof.

Examples of typical monomers for making the cross-linked polymer include styrene, butyl acrylate, acrylamide, acrylonitrile, methyl methacrylate, ethylene glycol dimethacrylate, vinyl pyridine, vinyl acetate, methyl acrylate, vinylbenzyl chloride, vinylidene chloride, acrylic acid, divinylbenzene, acrylamidomethylpropane sulfonic acid, vinyl toluene, etc. Preferably, the cross-linked polymer is polystyrene or poly(methyl methacrylate). Most preferably, it is polystyrene and the cross-linking agent is divinylbenzene.

Processes well known in the art yield non-uniformly sized particles, characterized by broad particle size distributions. The resulting beads can be classified by screening the produce beads spanning the range of the original distribution of sizes. Other processes such as suspension polymerization, limited coalescence, directly yield very uniformly sized particles.

The void-initiating materials may be coated with a slip agent to facilitate voiding. Suitable slip agents or lubricants include colloidal silica, colloidal alumina, and metal oxides such as tin oxide and aluminum oxide. The preferred slip agents are colloidal silica and alumina, most preferably, silica. The cross-linked polymer having a coating of slip agent may be prepared by procedures well known in the art. For example, conventional suspension polymerization processes wherein the slip agent is added to the suspension is preferred. As the slip agent, colloidal silica is preferred.

The void-initiating particles can also be inorganic spheres, including solid or hollow glass spheres, metal or ceramic beads or inorganic particles such as clay, talc, barium sulfate, calcium carbonate. The important thing is that the material does not chemically react with the core matrix polymer to cause one or more of the following problems: (a) alteration of the crystallization kinetics of the matrix polymer, making it difficult to orient, (b) destruction of the core matrix polymer, (c) destruction of the void-initiating initiating particles, (d) adhesion of the void-initiating particles to the matrix polymer, or (e) generation of undesirable reaction products, such as toxic or high color moieties.

Suitable classes of thermoplastic polymers for the core matrix-polymer of the composite film include polyolefins, polyesters, polyamides, polycarbonates, cellulosic esters, polystyrene, polyvinyl resins, polysulfonamides, polyethers, polyimides, polyvinylidene flouride, polyurethanes, polyphenylenesulfides, polytetrafluoroethylene, polyacetals, polysulfonates, polyester ionomers, and polyolefin ionomers. Copolymers and/or mixtures of these polymers can be used.

Suitable polyolefins include polypropylene, polyethylene, polymethylpentene, and mixtures thereof. Polyolefin copolymers, including copolymers of ethylene and propylene are also useful.

Suitable polyesters include those produced from aromatic, aliphatic or cycloaliphatic dicarboxylic acids of 4–20 carbon atoms and aliphatic or alicyclic glycols having from 2–24 carbon atoms. Examples of suitable dicarboxylic acids include terephthalic, isophthalic, phthalic, naphthalene dicarboxylic acid, succinic, glutaric, adipic, azelaic, sebacic, fumaric, maleic, itaconic, 1,4-cyclohexanedicarboxylic, sodiosulfoisophthalic and mixtures thereof. Examples of suitable glycols include ethylene glycol, propylene glycol, butanediol, pentanediol, hexanediol, 1,4-cyclohexanedimethanol, diethylene glycol, other polyethylene glycols and mixtures thereof. Such polyesters are well known in the art and may be produced by well known techniques, e.g., those described in U.S. Pat. Nos. 2,465,319 and U.S. Pat. No. 2,901,466. Preferred continuous matrix polyesters are those having repeat units from terephthalic acid or naphthalene dicarboxylic acid and at least one glycol selected from ethylene glycol, 1,4-butanediol and 1,4-cyclohexanedimethanol. Poly(ethylene terephthalate), which may be modified by small amounts of other monomers, is especially preferred. Other suitable polyesters include liquid crystal copolyesters formed by the inclusion of suitable amount of a co-acid component such as stilbene dicarboxylic acid. Examples of such liquid crystal copolyesters are those disclosed in U.S. Pat. Nos. 4,420,607, 4,459,402 and 4,468,510.

Useful polyamides include nylon 6, nylon 66, and mixtures thereof. Copolymers of polyamides are also suitable continuous phase polymers. An example of a useful polycarbonate is bisphenol-A polycarbonate. Cellulosic esters suitable for use as the continuous phase polymer of the composite films include cellulose nitrate, cellulose triacetate, cellulose diacetate, cellulose acetate propionate, cellulose acetate butyrate, and mixtures or copolymers thereof. Useful polyvinyl resins include polyvinyl chloride, poly(vinyl acetal), and mixtures thereof. Copolymers of vinyl resins can also be utilized.

The nonvoided skin layers of the composite film can be made of the same polymeric materials as listed above for the core matrix. The composite film can be made with skin(s) of the same polymeric material as the core matrix, or it can be made with skin(s) of different polymeric composition than the core matrix. For compatibility, an auxiliary layer can be used to promote adhesion of the skin layer to the core.

Addenda may be added to the core matrix $ and/or to the skins to improve the whiteness of these films. This would include any process which is known in the art including adding a white pigment, such as titanium dioxide, barium sulfate, clay, or calcium carbonate. This would also include adding fluorescing agents which absorb energy in the UV region and emit light largely in the blue region, or other additives which would improve the physical properties of the film or the manufacturability of the film.

The coextrusion, quenching, orienting, and heat setting of these composite films may be effected by any process which is known in the art for producing oriented film, such as by a flat film process or a bubble or tubular process. The flat film process involves extruding the blend through a slit dye and rapidly quenching the extruded web upon a chilled casting drum so that the core matrix polymer component of the film and the skin components(s) are quenched below their glass transition temperatures (Tg). The quenched film is then biaxially oriented by stretching in mutually perpendicular directions at a temperature above the glass transition temperature of the matrix polymers and the skin polymers. The film may be stretched in one direction and then in a second direction or may be simultaneously stretched in both directions. After the film has been stretched it is heat set by heating to a temperature sufficient to crystallize the polymers while restraining to some degree the film against retraction in both directions of stretching.

These composite films may be coated or treated after the coextrusion and orienting process or between casting and full orientation with any number of coatings which may be used to improve the properties of the films including printability, to provide a vapor barrier, to make them heat sealable, or to improve the adhesion to the support or to the receiver layers. Examples of this would be acrylic coatings for printability, coating polyvinylidene chloride for heat seal properties, or corona discharge treatment to improve printability or adhesion.

By having at least one nonvoided skin on the microvoided core, the tensile strength of the film is increased and makes it more manufacturable. It allows the films to be made at wider widths and higher draw ratios than when films are made with all layers voided. Coextruding the layers further simplifies the manufacturing process.

The following microvoided packaging films PF1 through PF12 are suitable for the practice of the invention when extrusion, pressure, or otherwise laminated to a support such as polyester, paper, synthetic paper, or another microvoided film.

PF1. BICOR OPPalyte 300 HW (Mobil Chemical Co.)

A composite film (38 μm thick) (d =0.64) consisting of a microvoided and orientated polypropylene core (approximately 77% of the total film thickness) with a layer of non-microvoided orientated polypropylene on each side; the void initiating material is poly(butylene terephthalate).

PF2. An internally manufactured microvoided composite film (89 μm thick) (d =0.31) consisting of a microvoided and oriented polypropylene core (approximately 94% of the total film thickness) with a non-microvoided, oriented polypropylene layer on each side; the void initiating material is microbeads of polystyrene crosslinked with divinyl benzene and coated with colloidal silica.

PF3. An internally manufactured microvoided composite film (33 μm thick) (d =0.33) consisting of a microvoided and oriented polypropylene core (approximately 91% of the total film thickness) with a non-microvoided, oriented polypropylene layer on each side; the void initiating material is microbeads of polystyrene crosslinked with divinyl benzene and coated with colloidal silica.

PF4. Hercules 315 WT 503/2B (Hercules Inc.) A composite film (33 μm thick) (d =0.66) consisting of a pigmented microvoided and orientated polypropylene core (approximately 78% of the total film thickness) with a white pigmented non-microvoided orientated polypropylene layer on each side; the void initiating material is calcium carbonate.

PF5. Hercules 400 WT 503/1B (Hercules, Inc.) A composite film (28 μm thick) (d =0.59) with a pigmented microvoided and orientated polypropylene core (approximately 85% of the total film thickness) and a single white pigmented non-microvoided orientated polypropylene surface layer on one side; the void initiating material is calcium carbonate.

PF6. Hercules 325 WT 502/1S (Hercules Inc.) A composite film (35 μm thick) (d =0.61) consisting of a pigmented microvoided and orientated polypropylene core (approximately 86% of the total film thickness) with a copolymer sealant layer on one side; the void initiating material is calcium carbonate.

PF7. OPPalyte 350 ASW (Mobil Chemical Co.) A composite film (30 μm thick) (d =0.82) with a microvoided and orientated polypropylene core (approximately 57% of the total film thickness) and a non-microvoided, oriented polypropylene layer on each side. On one side was an overcoat layer of polyvinylidene chloride. A layer of an acrylic resin was overcoated on the other side. The void initiating material is poly(butylene terephthalate).

PF8. OPPalyte 370 HSW (Mobil Chemical Co.) A composite film (28 μm thick) (d =0.75) consisting of a microvoided and orientated polypropylene core (approximately 65% of the total film thickness) with a layer of non-microvoided orientated polypropylene on each side. On one side was an overcoat layer of polyvinylidene chloride. The void initiating material is poly(butylene terephthalate).

PF9. OPPalyte 350 TW (Mobil Chemical Co.)

A composite film (38 μm thick) (d =0.62) consisting of a microvoided and orientated polypropylene core (approximately 73% of the total film thickness), with a titanium dioxide pigmented non-microvoided orientated polypropylene layer on each side; the void initiating material is poly(butylene terephthalate).

PF10. OPPalyte 233 TW (Mobil Chemical Co.) A composite film (63 μm thick) (d =0.53) with a microvoided and orientated polypropylene core (approximately 85% of the total film thickness), with a titanium dioxide pigmented non-microvoided orientated polypropylene layer on each side; the void initiating material is poly(butylene terephthalate).

PF11. OPPalyte 278 TW (Mobil Chemical Co.) A composite film (50 μm thick) (d =0.56) with a microvoided and orientated polypropylene core (approximately 80% of the total film thickness), with a titanium dioxide pigmented non-microvoided orientated polypropylene layer on each side; the void initiating material is poly(butylene terephthalate).

PF12. OPPalyte 250 ASW (Mobil Chemical Co.) A composite film (43 μm thick) (d =0.72) with a microvoided and orientated polypropylene core (approximately 62% of the total film thickness), and a layer of non-microvoided orientated polypropylene layer on each side. On one side was an overcoat layer of polyvinylidene chloride. A layer of an acrylic resin was overcoated on the other side. The void initiating material is poly(butylene terephthalate).

The support to which the microvoided composite films are laminated for the base of the dye-receiving element of the invention may be a polymeric, a synthetic paper, or a cellulose fiber paper support, or laminates thereof.

Preferred cellulose fiber paper supports include those disclosed in COpending, commonly assigned U.S. Ser. No. 07/822,522 of Warner et al., the disclosure of which is incorporated by reference. When using a cellulose fiber paper support, it is preferable to extrusion laminate the microvoided composite films using a polyolefin resin. During the lamination process, it is desirable to maintain minimal tension of the microvoided packaging film in order to minimize curl in the resulting laminated receiver support. The back side of the paper support (i.e., the side opposite to the microvoided composite film and receiver layer) may also be extrusion coated with a polyolefin resin layer (e.g., from about 10 to 75 $g/m^2$), and may also include a backing layer such as those disclosed in U.S. Pat. Nos. 5,011,814 and 5,096,875, the disclosures of which are incorporated by reference. For high humidity applications (>50% RH), it is desirable to provide a backside resin coverage of from about 30 to about 75 $g/m^2$, more preferably from 35 to 50 $g/m^2$, to keep curl to a minimum.

In one preferred embodiment, in order to produce receiver elements with a desirable photographic look and feel, it is preferable to use relatively thick paper supports (e.g., at least 120 μm thick, preferably from 120 to 250 μm thick) and relatively thin microvoided composite packaging films (e.g., less than 50 μm thick, preferably from 20 to 50 μm thick, more preferably from 30 to 50 μm thick).

In another embodiment of the invention, in order to form a receiver element which resembles plain paper, e.g. for inclusion in a printed multiple page document, relatively thin paper or polymeric supports (e.g., less than 80 μm, preferably from 25 to 80 μm thick) may be used in combination with relatively thin microvoided composite packaging films (e.g., less than 50 μm thick, preferably from 20 to 50 μm thick, more preferably from 30 to 50 μm thick).

The dye image-receiving layer of the receiving elements of the invention may comprise, for example, a polycarbonate, a polyurethane, a polyester, polyvinyl chloride, poly(styrene-co-acrylonitrile), poly(caprolactone) or mixtures thereof. The dye image-receiving layer may be present in any amount which is effective for the intended purpose. In general, good results have been obtained at a concentration of from about 1 to about 10 g/m$^2$. An overcoat layer may be further coated over the dye-receiving layer, such as described in U.S. Pat. No. 4,775,657 of Harrison et al., the disclosure of which is incorporated by reference.

Dye-donor elements that are used with the dye-receiving element of the invention conventionally comprise a support having thereon a dye containing layer. Any dye can be used in the dye-donor employed in the invention provided it is transferable to the dye-receiving layer by the action of heat. Especially good results have been obtained with sublimable dyes. Dye donors applicable for use in the present invention are described, e.g., in U.S. Pat. Nos. 4,916,112, 4,927,803 and 5,023,228, the disclosures of which are incorporated by reference.

As noted above, dye-donor elements are used to form a dye transfer image. Such a process comprises image-wise-heating a dye-donor element and transferring a dye image to a dye-receiving element as described above to form the dye transfer image.

In a preferred embodiment of the invention, a dye-donor element is employed which comprises a poly-(ethylene terephthalate) support coated with sequential repeating areas of cyan, magenta and yellow dye, and the dye transfer steps are sequentially performed for each color to obtain a three-color dye transfer image. Of course, when the process is only performed for a single color, then a monochrome dye transfer image is obtained.

Thermal printing heads which can be used to transfer dye from dye-donor elements to the receiving elements of the invention are available commercially. There can be employed, for example, a Fujitsu Thermal Head (FTP-040 MCS001), a TDK Thermal Head F415 HH7-1089 or a Rohm Thermal Head KE 2008-F3. Alternatively, other known sources of energy for thermal dye transfer may be used, such as lasers as described in, for example, GB No. 2,083,726A.

A thermal dye transfer assemblage of the invention comprises (a) a dye-donor element, and (b) a dye-receiving element as described above, the dye-receiving element being in a superposed relationship with the dye-donor element so that the dye layer of the donor element is in contact with the dye image-receiving layer of the receiving element.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following examples are provided to further illustrate the invention.

EXAMPLE 1

Thermal dye-transfer receiving elements A through K were prepared by coating the following layers in order on the composite film side of the different bases described below consisting of a paper stock support to which was extrusion laminated a microvoided composite film:

a) Subbing layer of Z-6020 (an aminoalkylene aminotrimethoxysilane) (Dow Corning Co.) (0.10 g/m$^2$) from ethanol.

b) Dye receiving layer of Makrolon 5700 (a bisphenol-A polycarbonate)(Bayer AG)(1.6 g/m$^2$), a co-polycarbonate of bisphenol-A and diethylene glycol (1.6 g/m$^2$), diphenyl phthalate (0.32 g/m$^2$), di-n-butyl phthalate (0.32 g/m$^2$), and Fluorad FC-431 (fluorinated dispersant) (3M Corp.) (0.011 g/m$^2$) from dichloromethane.

c) Dye receiver overcoat layer of a linear condensation polymer considered derived from carbonic acid, bisphenol-A, diethylene glycol, and an aminopropyl terminated o polydimethyl siloxane (49:49:2 mole ratio) (0.22 g/m$^2$), and 510 Silicone Fluid (Dow Corning Co.)(0.16 g/m$^2$), and Fluorad FC-431 (0.032 g/m$^2$) from dichloromethane.

Receiver A: The support was Vintage Gloss (a 70 pound, 76 μm thick clay coated paper stock) (Potlatch Co.) to which microvoided composite film PFl described above was extrusion laminated with pigmented polyolefin. The pigmented polyolefin was polyethylene (12 g/m$^2$) containing anatase titanium dioxide (13% by weight) and a stilbene-benzoxazole optical brightener (0.03% by weight). The backside of the stock support was extrusion coated with high density polyethylene (25 g/m$^2$).

Receiver B: The support was a paper stock (81 μm thick, made from a bleached hardwood kraft pulp) to which microvoided composite film PFl was extrusion laminated with pigmented polyolefin. The pigmented polyolefin and the backside polyethylene layer were the same as for Receiver A.

Receiver C: The support was a paper stock (120 μm thick, made from a 1:1 blend of Pontiac Maple 51 (a bleached maple hardwood kraft of 0.5 mm length weighted average fiber length) (Consolidated Pontiac, Inc.) and Alpha Hardwood Sulfite (a bleached red-alder hardwood sulfite of 0.69 mm average fiber length) (Weyerhaeuser Paper Co.)) to which microvoided composite film PFl was extrusion laminated with pigmented polyolefin. The pigmented polyolefin and the backside polyethylene layer were the same as for Receiver A.

Receiver D: The support was a paper stock (150 μm thick, made from the bleached hardwood kraft and bleached hardwood sulfite pulp mixture of the Receiver C support) to which microvoided composite film PF2 was extrusion laminated with pigmented polyolefin. The pigmented polyolefin and the backside polyethylene layer were the same as for Receiver A.

Receiver E: The support was a paper stock (150 μm thick, made from the bleached hardwood kraft and bleached hardwood sulfite pulp mixture of the Receiver C support) to which microvoided composite film PF3 was extrusion laminated with pigmented polyolefin. The pigmented polyolefin and the backside polyethylene layer were the same as for Receiver A.

Receiver F: The support was a paper stock (150 μm thick, made from the bleached hardwood kraft and bleached hardwood sulfite pulp mixture of the Receiver C support) to which microvoided composite film PF4 was extrusion laminated with pigmented polyolefin. The pigmented polyolefin and the backside polyethylene layer were the same as for Receiver A.

Receiver G: The support was a paper stock (150 μm thick, made from the bleached hardwood kraft and bleached hardwood sulfite pulp mixture of the Receiver C support) to which microvoided composite film PF5 was extrusion laminated with pigmented polyolefin (microvoided polypropylene core side of film PF5 contacting the pigmented polyolefin). The pigmented polyolefin and the backside polyethylene layer were the same as for Receiver A.

Receiver H: The support was a paper stock (150 μm thick, made from the bleached hardwood kraft and bleached hardwood sulfite pulp mixture of the Receiver C support) to which microvoided composite film PF6 was extrusion laminated with pigmented polyolefin (copolymer sealant layer side of film PF6 contacting the pigmented polyolefin). The pigmented polyolefin and the backside polyethylene layer were the same as for Receiver A.

Receiver I: The support was a paper stock (150 μm thick, made from the bleached hardwood kraft and bleached hardwood sulfite pulp mixture of the Receiver C support) to which microvoided composite film PF7 was extrusion laminated with pigmented polyolefin (polyvinylidene chloride overcoat side of film PF7 contacting the pigmented polyolefin). The pigmented polyolefin and the backside polyethylene layer were the same as for Receiver A.

Receiver J: The support was a paper stock (140 μm thick, made from the bleached hardwood kraft and bleached hardwood sulfite pulp mixture of the Receiver C support) to which microvoided composite film PF8 was extrusion laminated with pigmented polyolefin (polyvinylidene chloride overcoat side of film PF8 contacting the pigmented polyolefin). The pigmented polyolefin layer was the same as for Receiver A but coated at 25 g/m$^2$. The backside polyethylene layer was the same as for Receiver A but coated at 12 g/m$^2$.

Receiver K: The support was a paper stock (185 μm thick, made from a bleached hardwood kraft and bleached softwood sulfite pulp 1:1 mixture) to which microvoided composite film PFl was extrusion laminated with polypropylene (15 g/m$^2$). The backside of the paper stock support was extruded with high-density polyethylene (13 g/m$^2$).

Control dye-receivers C-1 through C-8 were prepared similar to the dye-receivers of the invention, but not comprising microvoided packaging films for the base.

Control receiver C-1 was prepared for Receiver A with the same paper stock, Vintage Gloss, as Receiver A, except a synthetic paper was extrusion laminated with pigmented polyolefin in place of composite film PFl. The synthetic paper was Yupo FPG-60 (Oji-Yuka Synthetic Paper Co.) (60 μm thick) (d =0.75) consisting of a calcium carbonate containing, microvoided and oriented polypropylene core (approximately 54 % of the total thickness) with a calcium carbonate (of higher loading than the core) containing microvoided polypropylene layer on each side. The backside polyethylene layer of the paper stock was the same as for Receiver A.

A second control receiver, C-2, for Receiver A was similarly prepared except the synthetic paper was Yupo SGG-80 (Oji-Yuka Synthetic Paper Co.) (80 μm thick) (d =0.80), consisting of a calcium carbonate containing, microvoided and oriented polypropylene core (approximately 51 % of the total thickness) with a calcium carbonate (of higher loading than the core) containing microvoided polypropylene layer on each side.

Control receiver C-3 was prepared for Receiver B using the same paper stock as Receiver B, except a synthetic paper, Yupo FPG-60 (Oji-Yuka Synthetic Paper Co.) described above for Control C-1, was extrusion laminated with pigmented polyolefin in place of composite film PFl.

Control receiver C-4 was prepared for Receiver C using the same paper stock as Receiver C, except a synthetic paper, Yupo SGG-80 (Oji-Yuka Synthetic Paper Co.) described above for Control C-2, was extrusion laminated with pigmented polyolefin in place of composite film PFl. $ Control receiver C-5 was prepared for Receivers D to J using the same paper stock as Receiver D, except a non-microvoided polyolefin film was extrusion laminated with pigmented polyolefin in place of the composite film. The non-microvoided polyolefin film was BICOR 306-B (Mobil Chemical Co.), a 25 μm thick orientated non-pigmented polypropylene film.

A second control receiver, C-6, for Receivers D to J was prepared using the same paper stock (120 μm thick) as Receiver C, except a non-microvoided polyester film was extrusion laminated with pigmented polyolefin in place of the composite film. The nonmicrovoided polyester film was unsubbed orientated poly(ethylene terephthalate) (6 μm thick).

Control receiver C-7 was prepared for Receiver K using the same paper stock (150 μm thick) as Receiver D, except each side was extruded with polyethylene. The front (receiving layer) side was polyethylene (22 g/m$^2$) containing anatase titanium dioxide (13% by weight) and optical brightener (0.03 % by weight). The backside of the paper stock support was extruded with high density polyethylene (25 g/m$^2$).

A second control receiver, C-8, for Receiver K was prepared using the same paper stock (120 μm thick) as Receiver C, except a synthetic paper, Yupo FPG-60 (Oji-Yuka Synthetic Paper Co.) described above for Control C-1, was extrusion laminated with pigmented polyolefin on both sides of the paper stock.

Magenta dye containing thermal dye transfer donor elements were prepared by coating on 6 μm poly(ethylene terephthalate) support:

a) a subbing layer of Tyzor TBT (a titanium tetra-n-butoxide) (duPont Co.) (0.12 g/m$^2$) from 1-butanol.
b) a dye-layer containing the magenta dyes illustrated below (0.12 and 0.13 g/m$^2$) and S-363 (Shamrock Technologies, Inc.) (a micronized blend of polyolefin and oxidized polyolefin particles) (0.016 g/m$^2$), in a cellulose acetate propionate binder (2.5% acetyl, 45% propionyl) (0.40 g/m$^2$) from a toluene, methanol, and cyclopentanone solvent mixture.

On the backside of the dye donor element was coated:

a) a subbing layer of Tyzor TBT (a titanium tetra-n-butoxide) (duPont Co.) (0.12 g/m$^2$) from 1-butanol
b) a slipping layer of Emralon 329 (a dry film lubricant of poly(tetrafluoroethylene) particles) (Acheson Colloids Co.) (0.59 g/m$^2$), BYK-320 (a polyoxyalkylene-methylalkyl siloxane copolymer)(BYK Chemie USA)(0.006 g/m$^2$), PS-513 (an aminopropyl dimethyl terminated polydimethylsiloxane) (Petrarch Systems, Inc.) (0.006 g/m$^2$), S-232 (a micronized blend of polyethylene and carnauba wax particles (Shamrock Technologies, Inc.) (0.016 g/m$^2$) coated from a toluene, n-propyl acetate, 2-propanol and 1-butanol solvent mixture.

The magenta dye structures are:

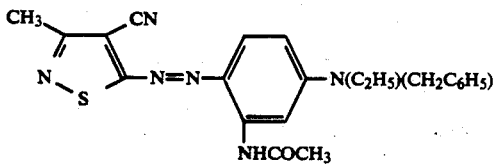

and

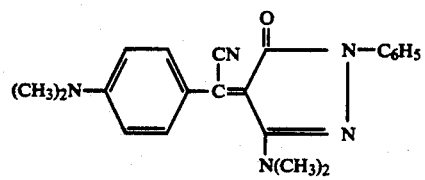

To evaluate relative printing efficiency using a thermal head, the dye-donors were printed at constant energy to provide a mid-scale test image on each dye-receiver. By comparison of the dye-densities produced at constant energy, the relative efficiency of transfer is comparable.

The dye side of the dye-donor element approximately 10 cm×15 cm in area was placed in contact with the polymeric receiving layer side of the dye-receiver element of the same area. The assemblage was fastened to the top of a motor-driven 56 mm diameter rubber roller and a TDK Thermal Head L-231 (No. 6-2R16-1), thermostated at 26° C., was pressed with a force of 36 Newtons against the dye-donor element side of the assemblage pushing it against the rubber roller.

The imaging electronics were activated and the assemblage was drawn between the printing head and roller at 7 mm/sec. coincidentally, the resistive elements in the thermal print head were pulsed at 128 μsec intervals (29 μsec/pulse) during the 33 msec/dot printing time. The voltage supplied to the print head was approximately 23.5 v with a power of approximately 1.3 watts/dot and energy of 7.6 mjoules/dot to create a "mid-scale" test image of non-graduated density (in the range 0.5–1.0 density units) over an area of approximately 9 cm×12 cm. The Status A Green reflection density was read and recorded as the average of 3 replicates.

To evaluate print uniformity a second test image of non-graduated density was run however the force applied to the thermal head was adjusted to 9 Newtons and the energy was modified to provide a more constant density range of 0.5 to 0.7. Each resulting image was evaluated for uniformity by reading a 5 cm×12 cm area on a Model MTI Mottle Tester (Tobias Associates, Inc.). The mottle index was obtained from three replicates and is tabulated below. Larger numbers indicate more density non-uniformity of the print.

To evaluate curl of the unprinted receiver a curl test was devised based on a modification of the TAPPI Useful Method 427 using a different sample size and measuring the curl only at 50% relative humidity Five samples of each receiver were cut to 21×28 cm with the length being parallel to the machine-coating direction of the support. The samples were equilibrated at 50 % RH for 24 hours. In all cases the curl, if any, occurred around the cross machine-coating direction (perpendicular to the machine-coating direction). The vertical distance between the ends of receiver were measured to the nearest half-millimeter. If samples were curled to the degree that they overlapped, the overlap was marked and measured. The distance of overlap was doubled and assigned a negative value. The percent curl was calculated as follows:

$$\frac{L-M}{L} \times 100 = \%\ \text{Curl}$$

where L equals the original length (28. cm in this case) and M equals the measured distance between ends. Samples that overlap themselves will have over 100% curl; a flat sample will have 0% curl. Curl values $ below 5% are considered desirable and equivalent. The results are presented in Table I below:

TABLE I

| RECEIVER | GREEN DENSITY | MOTTLE INDEX | % CURL |
|---|---|---|---|
| A | 0.59 | 340 | 23 |
| C-1 (Control) | 0.50 | 840 | >100 |
| C-2 (Control) | 0.55 | 950 | >100 |
| B | 0.59 | 290 | 23 |
| C-3 (Control) | 0.51 | 670 | >100 |
| C | 0.57 | 300 | <5 |
| C-4 (Control) | 0.41 | 920 | 55 |
| D | 0.72 | 220 | <5 |
| E | 0.66 | 200 | <5 |
| F | 0.68 | 270 | <5 |
| G | 0.68 | 260 | <5 |
| H | 0.60 | 260 | <5 |
| I | 0.70 | 300 | <5 |
| J | 0.52 | 270 | <5 |
| C-5 (Control) | 0.42 | 1150 | <5 |
| C-6 (Control) | 0.44 | 600 | 13 |
| K | 0.64 | 440 | <5 |
| C-7 (Control) | 0.47 | 590 | <5 |
| C-8 (Control) | 0.53 | 640 | 17 |

The data above show that thermal dyereceivers of the invention coated on bases comprising a paper support extrusion laminated with a microvoided composite film and an internal polyolefin layer are superior for the combined features of transferred dyedensity, print uniformity and percent curl compared to bases used for related prior art receivers.

EXAMPLE 2

Thermal dye-transfer receiving elements were prepared as described in Example 1 but the support consisted of poly(ethylene terephthalate) to produce the base for the receiver indicated below:

Receiver L: The support was a non-pigmented transparent poly(ethyleneterephthalate) film (100 μm thick) to which microvoided composite film PFl was extrusion laminated with pigmented polyolefin. The pigmented polyolefin was polyethylene (12 g/m$^2$) containing anatase titanium dioxide (13% by weight) and stilbene-benzoxazole optical brightener (0.03% by weight). The backside of the polyester support was extruded with the same pigmented polyolefin (25 g/m$^2$) as the receiving layer side.

Control receiver, C-9 for Receiver L was prepared using the poly(ethylene terephthalate) support (100 μm thick) of Receiver L, except a synthetic paper, Yupo SGG-80 (Oji-Yuka Synthetic Paper Co.) described above for Control C-2, was extrusion laminated with pigmented polyolefin in place of composite film PFl.

A second control receiver, C-10, for Receiver L was prepared using the poly(ethylene terephthalate) support (100 μm thick) of Receiver L, except a synthetic paper, Yupo FPG-60 (Oji-Yuka Synthetic Paper Co.) described above for Control C-1, was extrusion laminated with pigmented polyolefin on both sides of the poly(ethylene terephthalate) support.

The same dye-donors were prepared and used for evaluation of transferred dye density, print uniformity (mottle), and curl in the manner described in Example 1. The results are presented in Table II

TABLE II

| RECEIVER | GREEN DENSITY | MOTTLE INDEX | % CURL |
|---|---|---|---|
| L | 0.62 | 240 | <5 |
| C-9 (Control) | 0.57 | 650 | >100 |
| C-10 (Control) | 0.52 | 520 | <5 |

The data above show that a thermal dye-receiver of the invention including a base using a polyester support is superior for the combined features of transferred dye-density, print uniformity and curl compared to bases used for related prior art receivers. cl EXAMPLE 3

Thermal dye-transfer receiving elements were prepared as described in Example 1 but the support consisted of microvoided polymeric films, known also as synthetic papers, to produce the bases for the receivers indicated below.

Receiver M: The support was an orientated microvoided poly(ethylene terephthalate) (100 μm thick) film support (void initiating material is microbeads of crosslinked polystyrene coated with colloidal silica) of density =0.70 g/cm$^3$ prepared as described in U.S. Pat No. 4,994,312 to which microvoided composite film PF9 was extrusion laminated with pigmented polyolefin. The pigmented polyolefin was polyethylene (25 g/m$^2$) containing anatase titanium dioxide (13% by weight) and stilbene-benzoxazole optical brightener (0.03 % by weight). The backside of the synthetic paper support was extruded with high density polyethylene (25 g/m$^2$).

Receiver N: The support was Kimdura FPG130 (Kimberly Clark Co.), a microvoided and orientated synthetic paper stock (132 μm thick) of polypropylene, to which microvoided composite film PFl was extrusion laminated with pigmented polyolefin. The extruded polyolefin layers on both sides were the same as Receiver A.

A control receiver, C-11 for Receivers M and N was prepared using the microvoided and orientated synthetic paper stock of Receiver N except a synthetic paper, Yupo FPG-60 (Oji-Yuka Synthetic Paper Co.) described above for Control C-1, was extrusion laminated with pigmented polyolefin in place of the composite film. The pigmented polyolefin layer and backside polyethylene layer were the same as Receiver A.

The same dye-donors were prepared and used for evaluation of transferred dye density, print uniformity (mottle), and curl in the manner described in Example 1. The results are presented in Table III below:

TABLE III

| RECEIVER | GREEN DENSITY | MOTTLE INDEX | % CURL |
|---|---|---|---|
| M | 0.62 | 230 | <5 |
| N | 0.60 | 230 | <5 |
| C-11 (Control) | 0.52 | 570 | <5 |

The data above show that thermal dye-receivers of the invention with bases using a microvoided polymeric film support are superior for the combined features of transferred dye-density, print uniformity and curl compared to bases used for related prior art receivers.

EXAMPLE 4

Thermal dye-transfer receiving element were prepared as described in Example 1 using a microvoided polymeric composite film as a support extrusion laminated with additional microvoided composite films on both sides to produce the bases for the receivers indicated below.

Receiver O: The support was a microvoided composite film PF10, to which an additional microvoided composite film PF10 was extrusion laminated to each side with pigmented polyolefin. The pigmented polyolefin was polyethylene (25 g/m$^2$) containing anatase titanium dioxide (13% by weight) and stilbenebenzoxazole optical brightener (0.03% by weight). No additional backing layer was used.

As a control for Receiver O, the Control Receiver C-11 of Example 3 was used. The same dye-donors were prepared and used for evaluation of transferred dye density, print uniformity (mottle), and curl in the manner described in Example 1. The results are presented in Table IV below:

TABLE IV

| RECEIVER | GREEN DENSITY | MOTTLE INDEX | % CURL |
|---|---|---|---|
| O | 0.73 | 300 | <5 |
| C-11 (Control) | 0.52 | 570 | <5 |

The data above show a thermal dye-receiver of the invention with a base using a microvoided polymeric composite film support is superior for the combined features of transferred dye-density, print uniformity . and curl compared to bases used for related prior art receivers.

EXAMPLE 5

Thermal dye transfer receiving elements were prepared as described in Example 1 using a paper stock support but the microvoided composite film was pressure laminated with a polymeric adhesive layer rather than extrusion lamination to produce the bases for the receivers indicated below.

Receiver P: The support was a paper stock (120 μm thick, made from a bleached hardwood kraft and bleached hardwood sulfite pulp 1:1 mixture) to which microvoided composite film PFll was pressure laminated. Gelva 788 (a 20% solution of an acrylate copolymer in an ethyl acetate and toluene solvent mixture) (5.4 g/m$^2$) was coated on the paper stock and allowed to dry. The microvoided composite film was contacted with the coated side of the paper stock and the assemblage was passed through a pair of rubber rollers to ensure contact. No backing layer was employed on the paper support.

Control receiver C-12 for Receiver P was prepared using the same paper stock (120 μm thick) as Receiver P, except a synthetic paper, Yupo FPG-60 (Oji-Yuka Synthetic Paper Co.) described above for Control C-1 was pressure laminated with a polymeric adhesive. The polymeric adhesive and process was the same as described for Receiver P.

The same dye-donors were prepared and used for evaluation of transferred dye density, print uniformity (mottle). and curl in the manner described in Example 1. The results are presented in Table V below:

TABLE V

| RECEIVER | GREEN DENSITY | MOTTLE INDEX | % CURL |
|---|---|---|---|
| P | 0.75 | 280 | 75 |
| C-12 (Control) | 0.57 | 660 | >100 |

The data above show that a thermal dye-receiver of the invention coated on a base having a paper support pressure laminated with a microvoided composite film is superior for transferred dye-density, print uniformity and curl.

EXAMPLE 6

Thermal dye-transfer receiving elements were prepared as described in Example 1 using a paper stock support but the microvoided composite film was pressure laminated as described in Example 5 to both sides of the support to produce the base for the receiver indicated below.

Receiver Q: The support was Vintage Gloss (a clay coated paper stock, 70 pound, 76 μm thick) (Potlatch Co.) to which microvoided composite film PFll was pressure laminated to both sides. Gelva 788 (as described in Example 5) was coated on both sides of the paper stock (5.4 g/m$^2$ each side), each side was contacted with the microvoided composite film, and the assemblage was passed through a pair of rollers. No additional backing layer was used.

Control receiver C-13 was prepared for Receiver Q using the same Vintage Gloss paper stock as Receiver Q, except a synthetic paper, Yupo FPG-60 (Oji-Yuka Synthetic Paper Co.) described above for Control C-1 was pressure laminated with a polymeric adhesive on both sides of the support. The polymeric adhesive and process was the same as described for Receiver Q.

A second control receiver, C-14, for Receiver Q was prepared using a mixed hardwood kraft and hardwood sulfite paper stock (120 μm thick) as for Receiver P, and the synthetic paper, Yupo FPG-60 (Oji-Yuka Synthetic Paper Co.) described above for Control C-1 was pressure laminated with a polymeric adhesive on both sides of the support. The polymeric adhesive and process was the same as described for Receiver Q.

The same dye-donors were prepared and used for evaluation of transferred dye density, print uniformity (mottle), and curl in the manner described in Example 1. The results are presented in Table VI below:

TABLE VI

| RECEIVER | GREEN DENSITY | MOTTLE INDEX | % CURL |
|---|---|---|---|
| Q | 0.74 | 370 | 8 |
| C-13 (Control) | 0.56 | 1090 | 7 |
| C-14 (Control) | 0.57 | 810 | 12 |

The data above show that a thermal dye-receiver of the invention with a base having a paper support pressure laminated with dual microvoided composite films is superior for the combined features of transferred dye-density, print uniformity and curl.

EXAMPLE 7

Thermal dye-transfer receiving elements were prepared as described in Example 1 using a paper stock support to produce the base for the receivers indicated below:

Receiver R: The support was a paper stock (81 μm thick, made from a bleached hardwood kraft pulp) to which microvoided composite film PFll was extrusion laminated with clear, medium density polyethylene (12 g/m$^2$). The backside of the stock support was extrusion coated with high density polyethylene at a coverage of 25 g/m$^2$.

Receiver S: Same paper stock, microvoided composite film and frontside polyolefin resin as Receiver R. The backside of the stock support, however, was extrusion coated with high density polyethylene at a coverage of 37 g/m$^2$.

The same dye-donors were prepared and used for evaluation of transferred dye density and print uniformity (mottle) in a manner described in Example 1. The evaluation of curl was the same as described in Example 1 except that in addition to 50% relative humidity, the samples were conditioned and measured at 20% and 70% relative humidity. The results are presented in Table VII below:

TABLE VII

| RECEIVER | GREEN DENSITY | MOTTLE INDEX | % CURL 20% RH | % CURL 50% RH | % CURL 70% RH |
|---|---|---|---|---|---|
| R | 0.64 | 273 | <5 | 9 | 15 |
| S | 0.63 | 312 | <5 | <5 | <5 |

The data above show that a thermal dye-receiver of the invention coated on a base comprising a paper support extrusion laminated with a microvoided composite film and with an increased polyolefin resin backside coverage is superior for curl performance for high humidity applications.

The invention has been described in detail with particular reference to preferred embodiments thereof, but it will be understood that variations and modifications can be effected within the spirit and scope of the invention.

What is claimed is:

1. In a dye-receiving element for thermal dye transfer comprising a base having thereon a dye image-receiving layer, the improvement wherein the base comprises a composite film laminated to a support, the dye image-receiving layer being on the composite film side of the base, and the composite film comprising a microvoided thermoplastic core layer and at least one substantially void-free thermoplastic surface layer.

2. The element of claim 1, wherein the thickness of the composite film is from 30 to 70 μm.

3. The element of claim 1, wherein the core layer of the composite film comprises from 30 to 85% of the thickness of the composite film.

4. The element of claim 1, wherein the overall density of the composite film is from 0.3 to 0.7 g/cm$^3$.

5. The element of claim 1, wherein the composite film comprises a microvoided thermoplastic core layer having a substantially void-free thermoplastic surface layer on each side thereof.

6. The element of claim 1, wherein the support comprises synthetic paper.

7. The element of claim 1, wherein the support comprises a non-voided polymer film.

8. The element of claim 1, wherein the support comprises cellulose fiber paper.

9. The element of claim 8, wherein the paper support is from 120 to 250 μm thick and the composite film is from 30 to 50 μm thick.

10. The element of claim 8, further comprising a polyolefin backing layer on the side of the support opposite to the composite film.

11. The element of claim 10, wherein the polyolefin backing layer is present at a coverage of from 30 to 75 g/m$^2$.

12. The element of claim 1, wherein the composite film comprises a microvoided and orientated polypropylene core layer with a surface layer of non-microvoided orientated polypropylene on each side.

13. The element of claim 12, wherein the thickness of the composite film is from 30 to 70 μm.

14. The element of claim 12, wherein the support is a cellulose fiber paper support from 120 to 250 μm thick and the composite fi]m is from 30 to 50 μm thick.

15. The element of claim 1, wherein the core layer of the composite film comprises a microvoided and orientated thermoplastic polymer and a polymeric void-initiating material.

16. In a process of forming a dye transfer image comprising:

a) imagewise-heating a dye-donor element comprising a support having thereon a dye layer comprising a dye dispersed in a binder, and b) transferring a dye image to a dye-receiving element comprising a base having thereon a dye image-receiving layer to form said dye transfer image, the improvement wherein the dye-receiving element base comprises a composite film laminated to a support, the dye image-receiving layer being on the composite film side of the base, and the composite film comprising a microvoided thermoplastic core layer and at least one substantially void-free thermoplastic surface layer.

17. The process of claim 16, wherein the composite film comprises a microvoided thermoplastic core layer having a substantially void-free thermoplastic surface layer on each side thereof, the thickness of the composite film being from 30 to 70 μm.

18. The process of claim 16, wherein the support comprises cellulose fiber paper from 120 to 250 μm thick and the composite film is from 30 to 50 μm thick and comprises a microvoided and orientated polypropylene core layer with a surface layer of non-microvoided orientated polypropylene on each side.

19. In a thermal dye transfer assemblage comprising:

a) a dye-donor element comprising a support having thereon a dye layer comprising a dye dispersed in a binder, and b)a dye-receiving element comprising a support having thereon a dye image-receiving layer, said dye-receiving element being in a superposed relationship with said dye-donor element so that said dye layer is in contact with said dye image-receiving layer, The improvement wherein the dye-receiving element base comprises a composite film laminated to a support, the dye image-receiving layer being on the composite film side of the base, and the composite film comprising a microvoided thermoplastic core layer and at least one substantially void-free thermoplastic surface layer.

20. The assemblage of claim 19, wherein the thickness of the composite film is from 30 to 70 μm.

* * * * *